US005302136A

United States Patent [19]

St. Germain et al.

[11] Patent Number: 5,302,136

[45] Date of Patent: Apr. 12, 1994

[54] APPARATUS FOR POSITIVELY PREVENTING MISENGAGEMENT OF MULTIPOINT CONNECTOR ELEMENTS

[75] Inventors: Ronald E. St. Germain, Amesbury; Lawrence Pardo, Boxford, both of Mass.

[73] Assignee: Modicon, Inc., North Andover, Mass.

[21] Appl. No.: 980,573

[22] Filed: Nov. 23, 1992

[51] Int. Cl.[5] ..... H01R 13/629

[52] U.S. Cl. ..... 439/376; 439/924; 439/341

[58] Field of Search ..... 439/341, 376, 924, 326

[56] References Cited

U.S. PATENT DOCUMENTS

| | | | |
|---|---|---|---|
| 3,171,704 | 3/1965 | Meile | 439/341 |
| 3,617,985 | 11/1971 | Kehl | 439/341 |
| 3,668,605 | 6/1972 | Albert | 439/341 |
| 4,151,580 | 4/1979 | Struger | 361/415 |
| 4,257,665 | 3/1981 | John | 439/341 |
| 4,738,632 | 4/1988 | Schmidt et al. | 439/341 |
| 4,869,681 | 9/1989 | Vache | 439/341 |
| 5,032,087 | 7/1991 | Koiner et al. | 439/341 |

FOREIGN PATENT DOCUMENTS

| | | | |
|---|---|---|---|
| 0165434 | 5/1988 | European Pat. Off. . | |
| 2810071 | 9/1979 | Fed. Rep. of Germany . | |
| 3744277 | 7/1988 | Fed. Rep. of Germany | 439/376 |

*Primary Examiner*—Gary F. Paumen

*Attorney, Agent, or Firm*—Ware, Fressola, Van Der Sluys & Adolphson

[57] ABSTRACT

An apparatus (10) for positively preventing misengagement of multipoint connector elements includes a mounting rack (26) having a pivot slot (18) and a stepped guide surface (32), along with an associated receptacle element (34) of a multipoint connector. The apparatus (10) also includes a housing (44) having a pivot pin (20) and a stepped guide surface (50), along with an associated plug element (54) of multipoint connector. Only when the pivot pin (20) is fully seated in the pivot slot (18) will the receptacle (34) and plug (54) elements be able to engage. Otherwise, the stepped guide surfaces (32, 50) act to positively prevent such engagement. Also, the stepped guide surfaces (32, 50) are concentrically mated to provide angular engagement and disengagement paths that result in a plurality of plug pin contacts (68) and receptacle socket contacts (70) engaging and disengaging in a sequential order, respectively.

18 Claims, 12 Drawing Sheets

FIG. 3
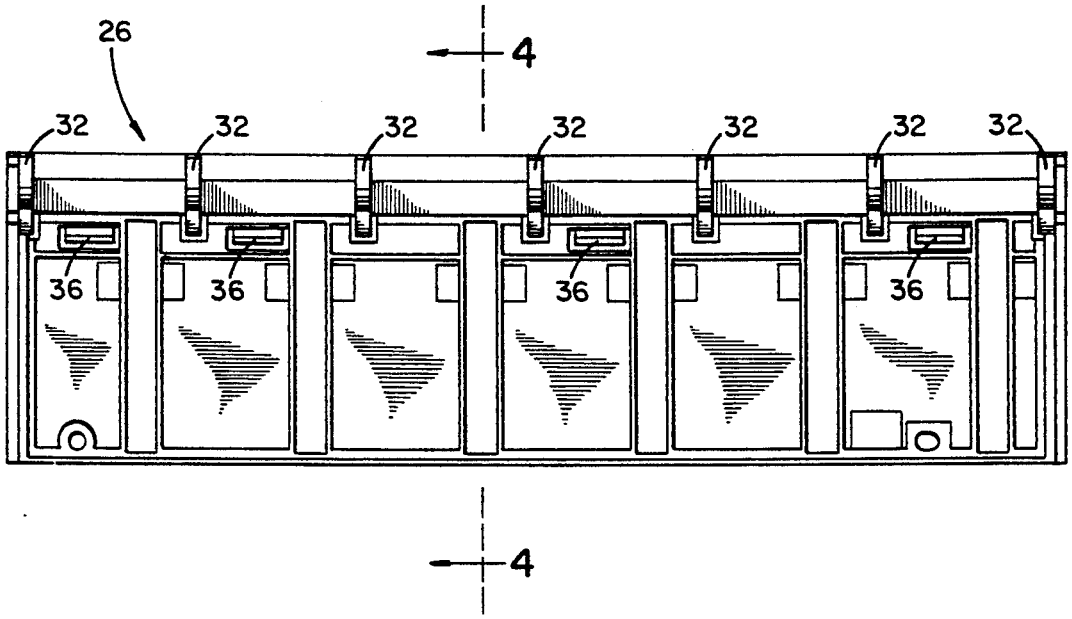
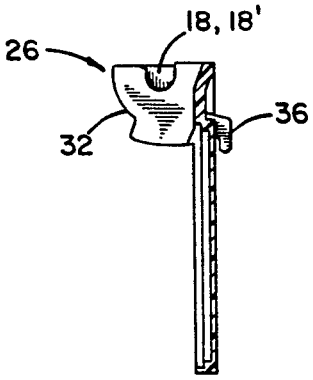
FIG. 4

APPARATUS FOR POSITIVELY PREVENTING MISENGAGEMENT OF MULTIPOINT CONNECTOR ELEMENTS

BACKGROUND OF THE INVENTION

1. Field of the Invention

The present invention relates to methods for insuring that multipoint connector elements are properly aligned and engaged and, more particularly, to an apparatus for positively preventing misengagement of multipoint connector elements when they are not properly aligned.

2. Description of the Prior Art

The use of multipoint connectors is well known in the art of electrical connection. Such use allows a plurality of electrical signals to be transmitted from a conventional male-type element, or plug, of a multipoint connector to a conventional female-type element, or receptacle, of a multipoint connector, and vice versa. Of course, for these electrical signal transmissions to occur, the plug and receptacle elements of the multipoint connector must be properly aligned and engaged.

Several prior art techniques have been used to positively insure proper alignment and subsequent proper engagement of multipoint connectors. For example, U.S. Pat. No. 4,257,665, describes a technique where a receptacle element of a multipoint connector provides a projecting arm having a curved pivot surface that fits into an aperture formed in a corresponding plug element. When inserted through the aperture, the projecting arm guides a pivot movement between the receptacle and the plug elements to positively insure a proper alignment and engagement. Also, in U.S. Pat. No. 3,668,605, a technique is described where a plug element of a multipoint connector provides a pivot pin and an alignment tongue that fit into a pair of alignment slots and an opening, respectively, provided by a corresponding receptacle element. The angle of the alignment tongue when inserted through the opening is such to cause the pivot pin to be firmly seated in the alignment slots, thereby positively insuring a proper alignment and engagement of the connector elements.

Although both of the above-mentioned patents describe valid techniques for positively insuring proper alignment and subsequent proper engagement of multipoint connector elements, neither describes a technique for positively preventing misengagement of multipoint connector elements when they are not properly aligned. Such positive prevention is addressed by the present invention described herein.

SUMMARY OF THE INVENTION

The present invention contemplates an apparatus for positively preventing misengagement of multipoint connector elements when they are not properly aligned. Such positive prevention is realized by combining a pivot action, similar to that described in the prior art, with two pairs of unique mating concentric guide surfaces that act to stop the pivot action, and hence an engagement of the multipoint connector elements, when the multipoint connector elements are not properly aligned. The mating concentric guide surfaces are unique in that they are stepped, thereby causing the pivot action of the connector elements to be stopped by opposing steps when the connector elements are not properly aligned.

Both pairs of unique mating concentric guide surfaces are formed in a similar manner, wherein a first stepped concentric guide surface is formed in a housing structure that has an associated plug-type connector element, and a second stepped concentric guide surface is formed in a mounting structure that has an associated receptacle-type connector element. The housing structure also provides a pair of pivot pins, while the mounting structure also provides a corresponding pair of pivot slots. Thus, the pivot action between the plug element and the receptacle element, or the housing structure and the mounting structure, respectively, is dictated by seating the pivot pins within the pivot slots. However, only when the pivot pins are fully seated within the pivot slots will the steps of the unique mating concentric guide surfaces allow engagement of the connector elements, thereby positively preventing misengagement until proper alignment is obtained.

Accordingly, the primary objective of the present invention is to provide a simple and effective means for positively preventing misengagement of multipoint connector elements when they are not properly aligned.

Another objective of the present invention is to provide a means for sequentially engaging and disengaging electrical contacts in multipoint connector elements.

Other objectives and advantages of the present invention will become apparent to those skilled in the art from the following detailed description read in conjunction with the appended claims and the drawings attached hereto.

BRIEF DESCRIPTION OF THE DRAWINGS

FIG. 3 is a front view of a mounting rail taken along line 3—3 of FIG. 2.

FIG. 4 is a cross-sectional side view of a mounting rail taken along line 4—4 of FIG. 3.

PREFERRED EMBODIMENT OF THE PRESENT INVENTION

Figure 1:
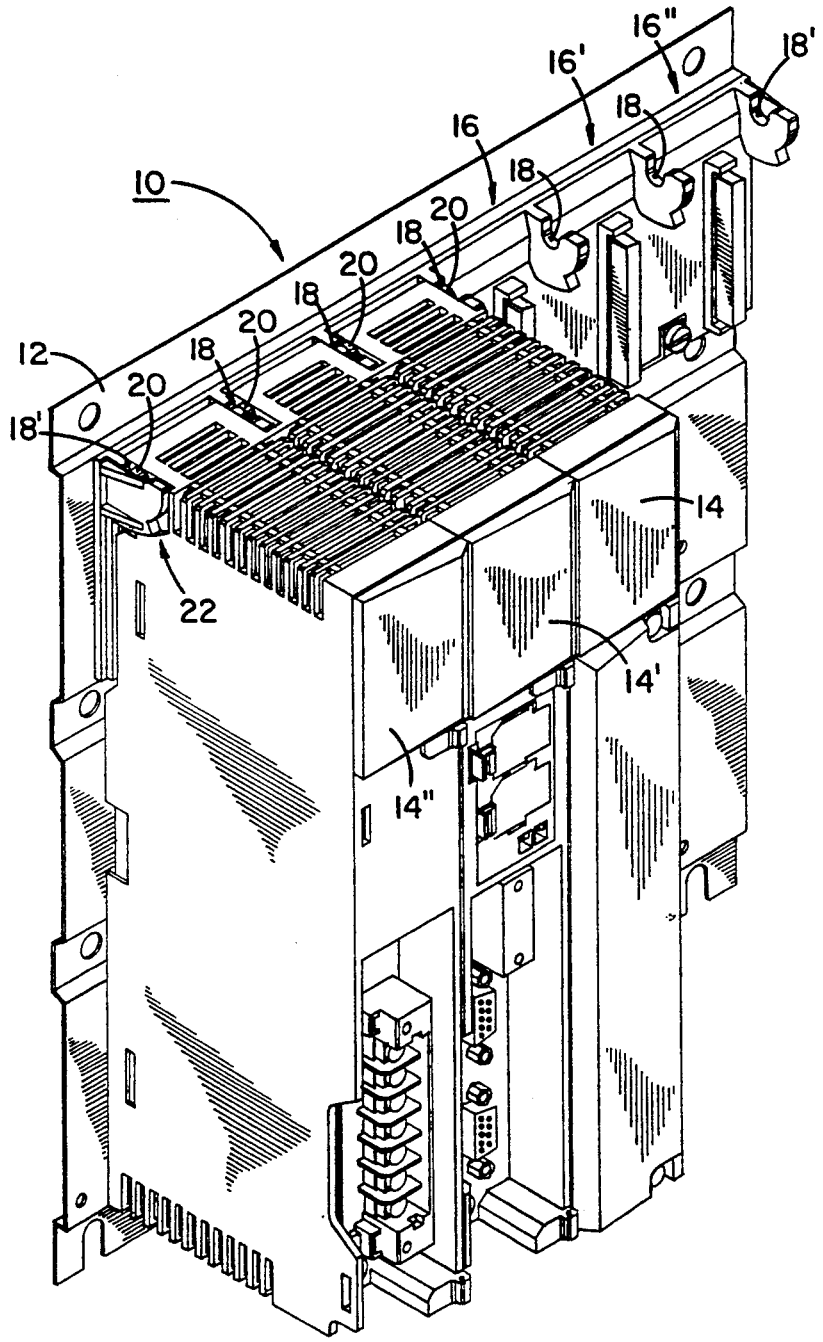
FIG. 1 is a perspective view of a portion of a modular programmable logic controller (PLC) system incorporating the present invention concept for positively preventing misengagement of multipoint connector elements when they are not properly aligned.

Referring to FIG. 1, there is shown a portion 10 of a modular programmable logic controller (PLC) system to illustrate one practical use of the present invention concept to be described herein. The portion 10 of the PLC system shown can be broken down into a mounting assembly 12 and three PLC modules 14, 14', 14''. In general, the mounting assembly 12 is stationary and it supports the three portable PLC modules 14, 14', 14'' which are portable. The mounting assembly 12 is also capable of supporting three additional PLC modules in the three spare areas 16, 16', 16'' to the right of the three PLC modules 14, 14', 14'' shown. However, these additional PLC modules are not shown for purposes of figure clarity.

The three PLC modules 14, 14', 14'' are supported by the mounting assembly 12 through a simple pivot pin and pivot slot arrangement. Each PLC module 14, 14', 14'' has two associated pivot pins 20 and the mounting assembly 12 provides a number of pivot slots 18, 18', each of which supports at least one of the PLC module pivot pins 20. Thus, the pivot slots 18, 18' of the mounting assembly 12 support the pivot pins 20 of the PLC modules 14, 14', 14'', and hence the PLC modules 14, 14', 14'' themselves. It should be noted that the outer pivot slots 18' provide approximately one half the slot area that the inner pivot slots 18 provide since these outer pivot slots 18' are only required to support a single pivot pin 20.

The simple pivot pin 20 and pivot slot 18, 18' arrangement is enhanced, according to the present invention, by mating concentric guide surfaces 22 that are formed between the PLC modules 14, 14', 14'' and the mounting assembly 12. As will be soon described in more detail, the combination of the pivot pins 20 and pivot slots 18, 18' arrangement and the mating concentric guide surfaces 22 acts to positively prevent misengagement of multipoint connector elements when they are not properly aligned.

Figure 2:
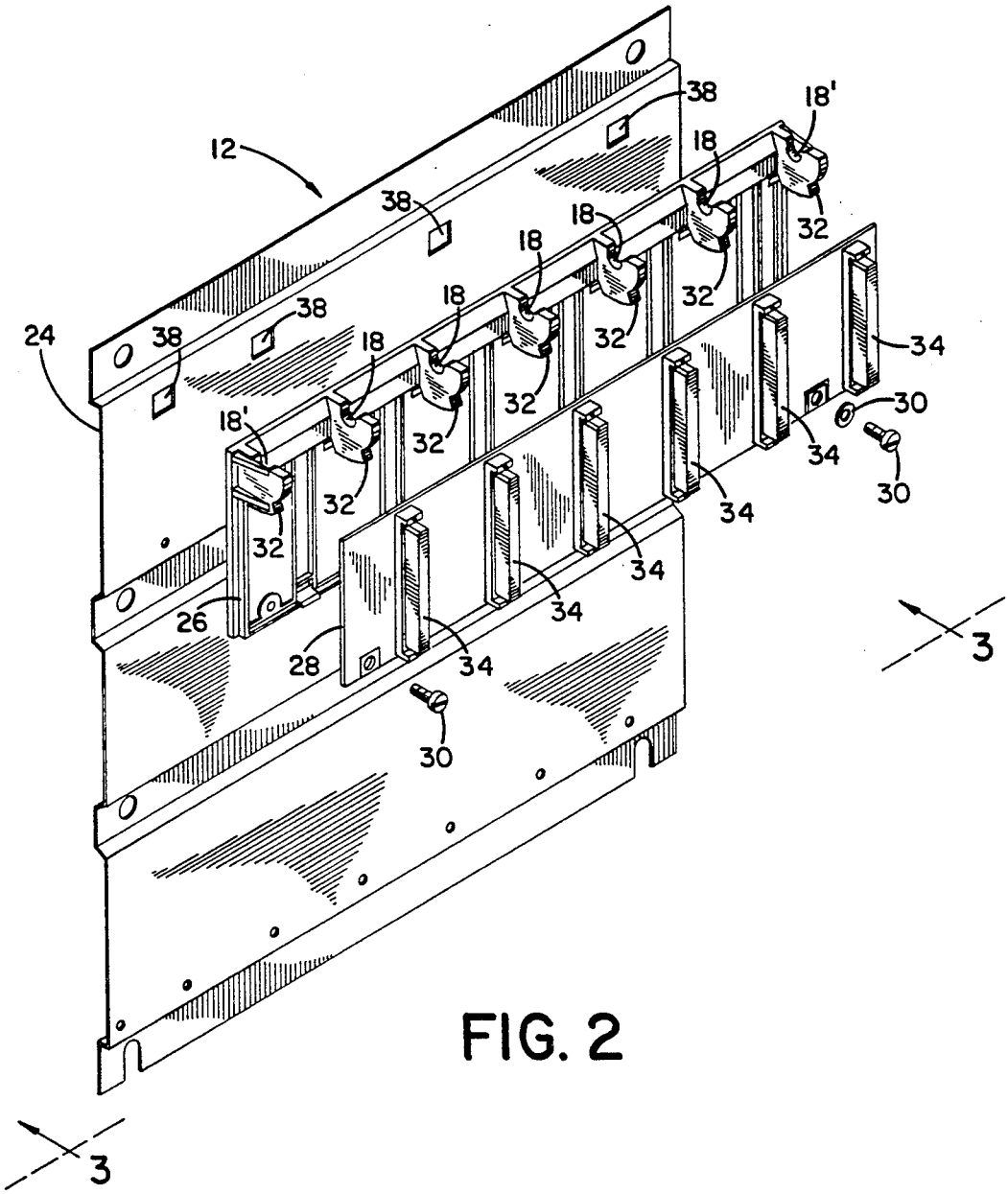
FIG. 2 is an exploded perspective view of a mounting assembly corresponding to the modular PLC system described in FIG. 1.

Referring to FIG. 2, there is shown an exploded view of the mounting assembly 10 described in FIG. 1. The mounting assembly 12 is comprised of a backplate 24, a mounting rail 26, a backplane printed circuit board 28, and some miscellaneous mounting hardware 30. The mounting rail 26 provides the pivot slots 18, 18' for supporting the PLC modules 14, 14', 14'', as described in FIG. 1. Associated with each of the pivot slots 18, 18' is a stepped guide surface 32 which, when mated with one of the previously described corresponding stepped guide surfaces associated with one of the PLC modules 14, 14', 14'', forms one of the present invention mating concentric guide surfaces 22.

The backplane printed circuit board 28 is secured to the mounting rail 26, and hence to the backplate 24, by the miscellaneous mounting hardware 30. Associated with the backplane printed circuit board 28 are a number of receptacle-type elements 34 of multipoint connectors. These receptacle elements 34 are positioned on the backplane printed circuit board 28 such that there is one receptacle element 34 located between each adjacent pivot slot 18, 18' and stepped guide surface 32 extrusion when the mounting assembly 12 is fully assembled. Thus, each receptacle element 34 is positioned in a location where a PLC module 14, 14', 14'' may be positioned. Accordingly, as will be shown shortly, each of these receptacle elements 34 may mate with a corresponding plug-type element associated with one of the previously described PLC modules 14, 14', 14'', if the PLC modules 14, 14', 14'' are properly aligned.

Referring to FIG. 3, there is shown a front view of the mounting rail 26. FIG. 4 is a cross-sectional view of the mounting rail shown in FIG. 3 with detail given to the pivot slots 18, 18' and the stepped guide surfaces 32. Also shown in FIG. 4 is a support bracket 36 that further secures the mounting rail to the backplate 24 through a corresponding support opening 38, as shown in FIG. 2.

Figure 5:
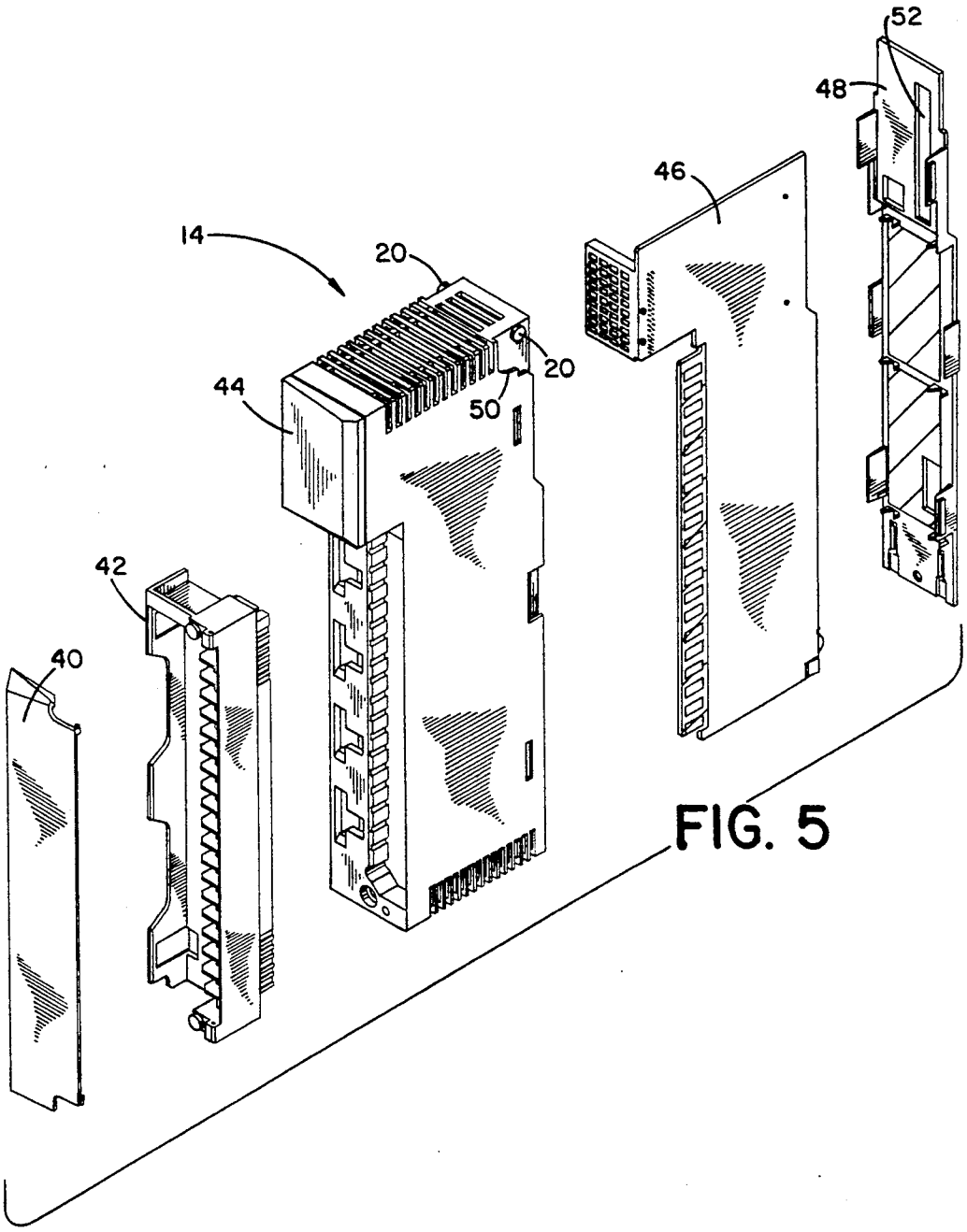
FIG. 5 is an exploded perspective view of a PLC module corresponding to the modular PLC system described in FIG. 1.
Figures 6A, 6B, 6C:
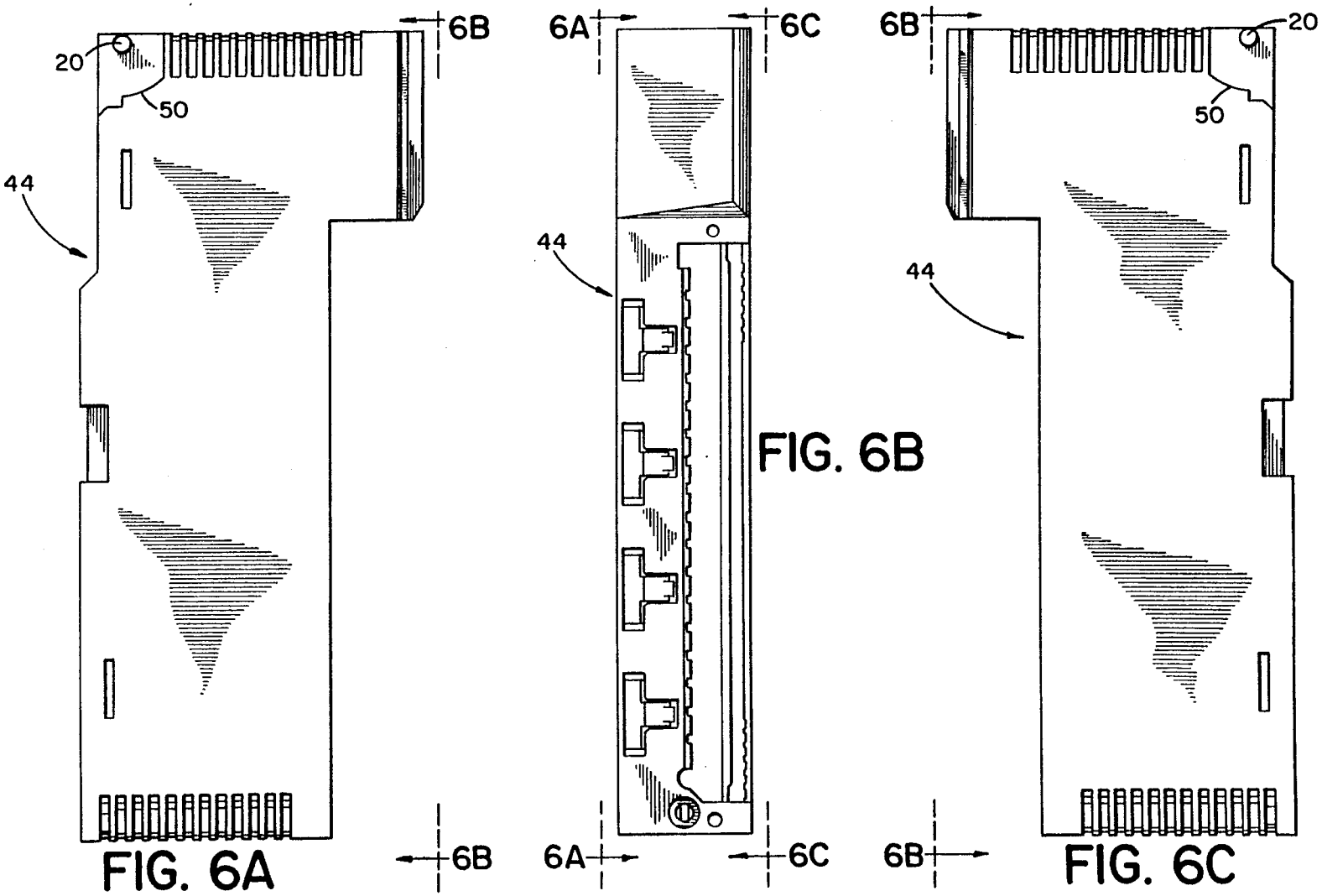
FIG. 6A is a side view of a PLC module housing taken along line 6A—6A of FIG. 6B.
FIG. 6B is a front view of a PLC module housing taken along line 6B—6B of FIG. 6A or line 6B—6B of FIG. 6C.
FIG. 6C is a side view of a PLC module housing taken along line 6C—6C of FIG. 6B.

Referring to FIG. 5, there is shown an exploded view of one type 14 of the PLC modules 14, 14', 14'' shown in FIG. 1. This input/output (I/O) type 14 of PLC module is comprised of a front door panel 40, an I/O connector 42, a housing 44, an I/O printed circuit board assembly 46, and a rear panel 48. The housing 44 provides the pivot pins 20 that are supported by the mounting rail pivot slots 18, 18' as described in FIG. 1. Associated with each pivot pin 20 is a stepped guide surface 50 which, when mated with one of the previously described corresponding stepped guide surfaces 32 associated with one of the pivot slots 18, 18', forms one of the present invention mating concentric guide surfaces 22. Referring to FIGS. 6A, 6B and 6C, the housing 44 is shown with detail given to the pivot pins 20 and the stepped guide surfaces 50.

Referring back to FIG. 5, the I/O printed circuit board assembly 46 is secured within the housing 44 by the rear panel 48 when the module 14 is fully assembled. Thus, access to the I/O printed circuit board assembly 46, when it is secured in the housing 44, can only be obtained through the I/O connector 42, upon opening the front door panel 40, or through an opening 52 in the rear panel 48. This rear panel opening 52 provides access to the I/O printed circuit assembly 46 by way of a plug-type element 54 of a multipoint connector, which is shown in FIGS. 7A and 7B.

Figures 7A, 7B, 7C:
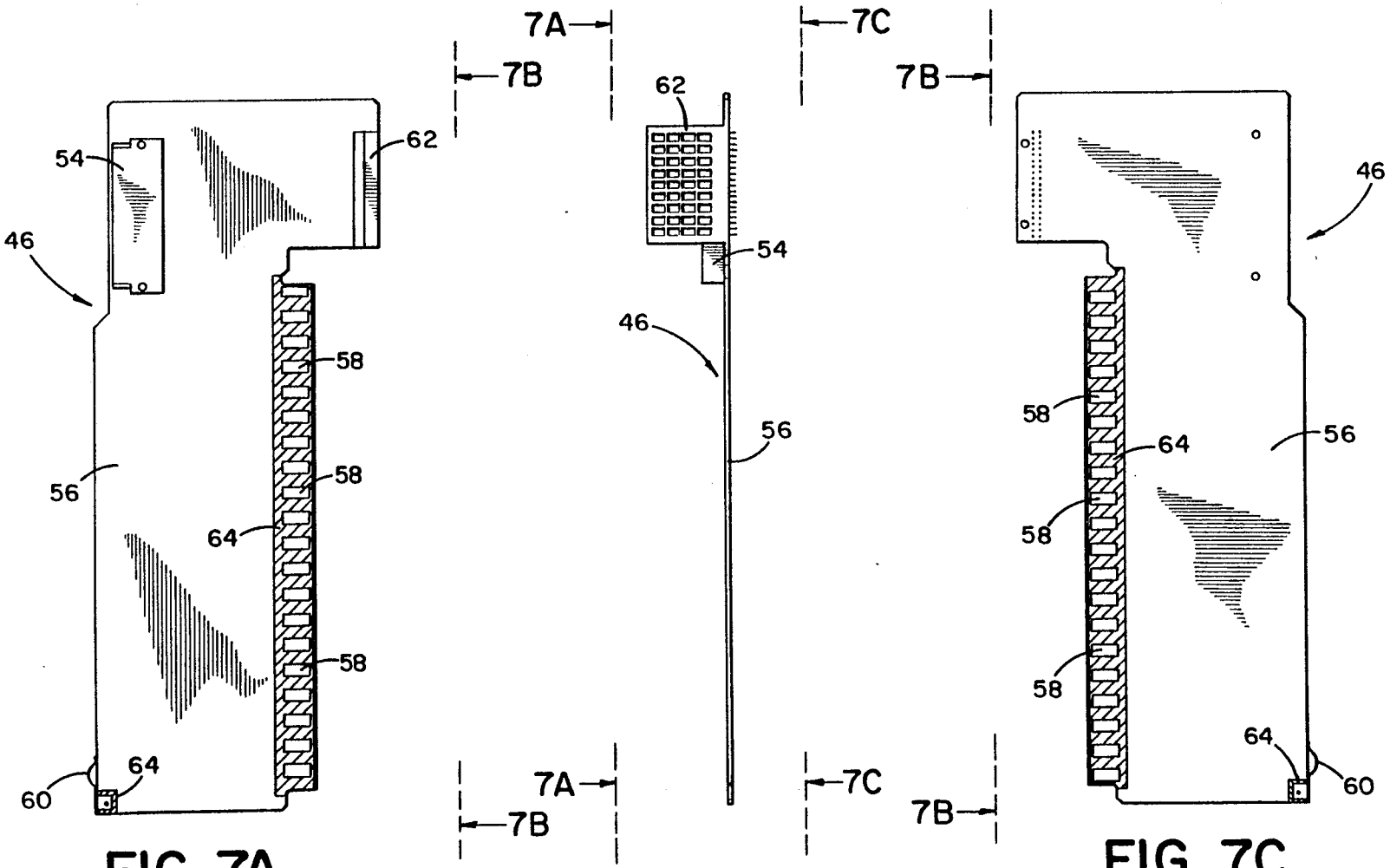
FIG. 7A is a side view of a PLC module printed circuit board assembly taken along line 7A—7A of FIG. 7B.
FIG. 7B is a front view of a PLC module printed circuit board assembly taken along line 7B—7B of FIG. 7A or line 7B—7B of FIG. 7C.
FIG. 7C is a side view of a PLC module printed circuit board assembly taken along line 7C—7C of FIG. 7B.

Referring to FIGS. 7A, 7B, and 7C, there is shown the I/O printed circuit board assembly 46 comprising a printed circuit board 56 having a plurality of electrical finger contacts 58 that connect with the previously described I/O connector 42, a ground clip 60, an LED display module 62, and the plug-type multipoint connector element 54. The plug element 54 is positioned on the printed circuit board 56 such that its internal pin contacts are facing out through the opening 52 in the rear panel 48 shown in FIG. 5. It should be noted that the shaded regions 64 on the printed circuit board 56 indicate areas where components are not allowed to be mounted.

The preceding figures and written description detail, among other things, the mounting assembly 12 having the pivot slots 18, 18' and the stepped guide surfaces 32, and the I/O type of PLC module 14 having the pivot pins 20 and the corresponding stepped guide surfaces 50. The mounting assembly also has its associated receptacle multipoint connector element 34, while the PLC module 14 has its associated plug multipoint connector element 54. It should be noted, however, that the present invention is not dictated by what type of multipoint connector element is associated with either the mounting assembly 12 or the PLC module 14.

Figure 8B:
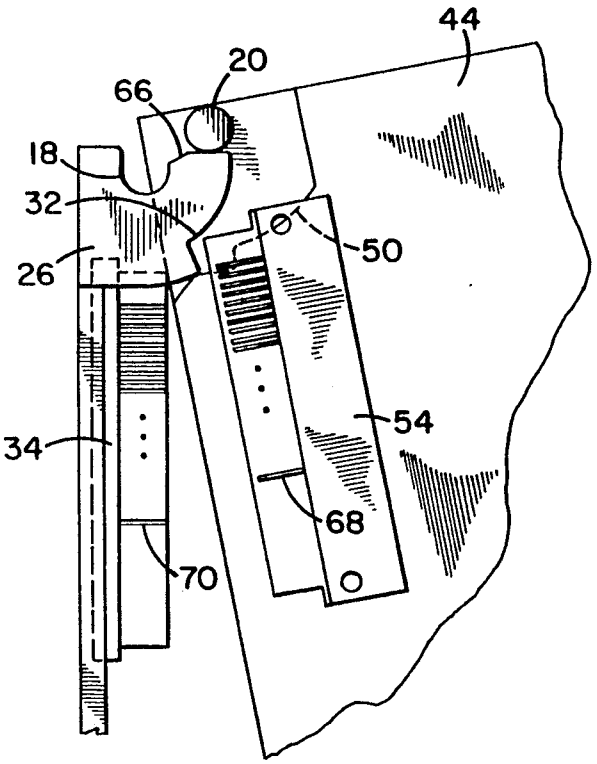
FIGS. 8A through 8K show a succession of steps detailing the correct procedure for properly aligning and engaging multipoint connector elements according to the present invention.
Figure 8A:
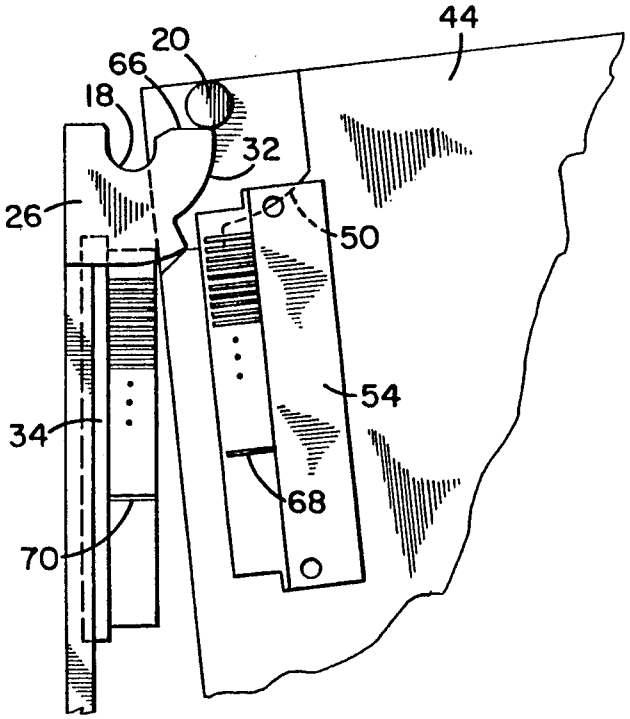
Figure 8D:
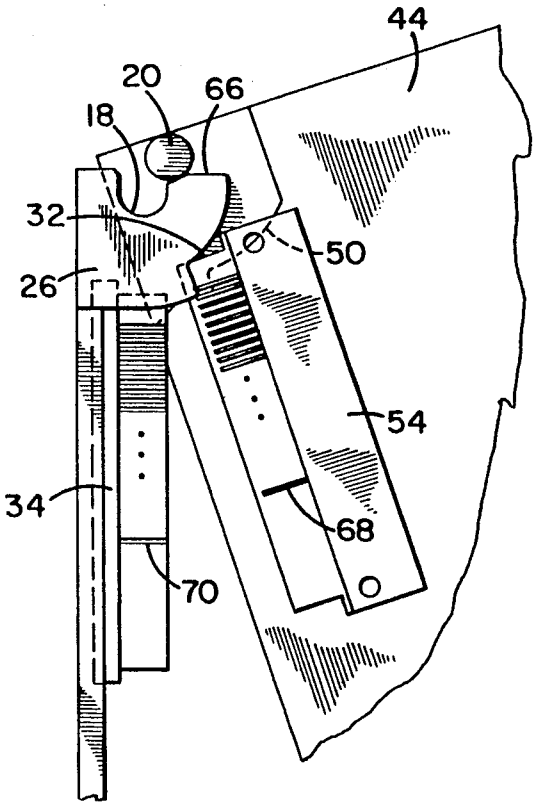
Figure 8C:
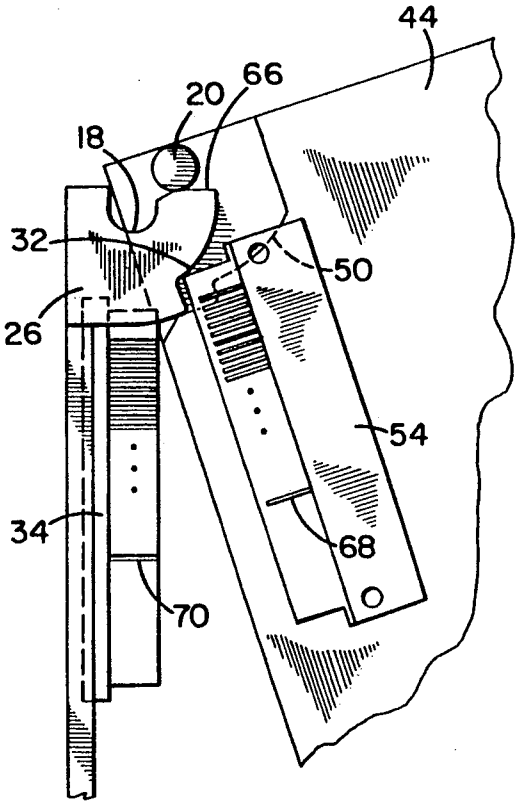
Figure 8F:
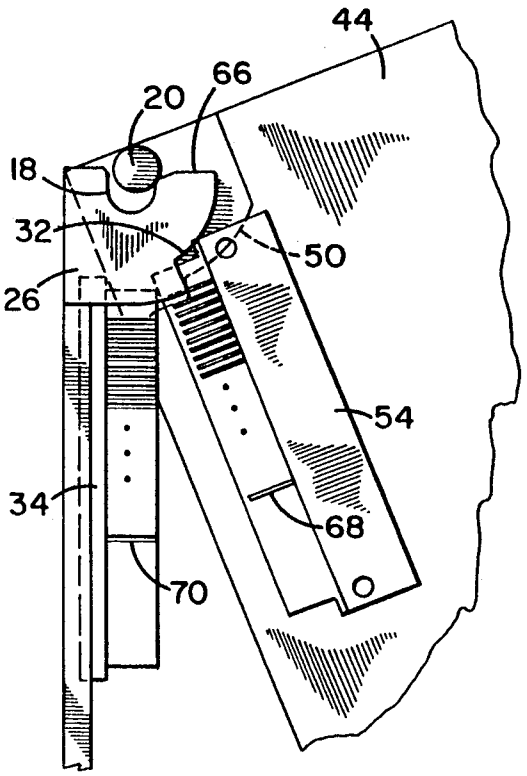

Referring to FIGS. 8A through 8K, there is shown a succession of steps detailing the correct procedure for properly aligning and engaging multipoint connector elements according to the present invention. Referring specifically to FIG. 8A, a cutaway portion of a mounting rail 26 is shown having a pivot slot 18 and a stepped guide surface 32, along with an associated receptacle-type multipoint connector element 34. Also shown is a cutaway portion of a PLC module housing 44 having a pivot pin 20 and a stepped guide surface 50, along with an associated plug-type multipoint connector element 54.

Figure 8E:
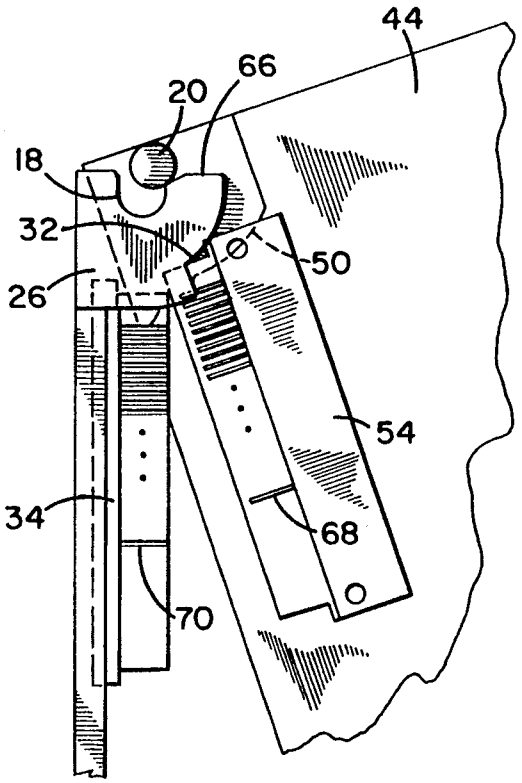
Figure 8H:
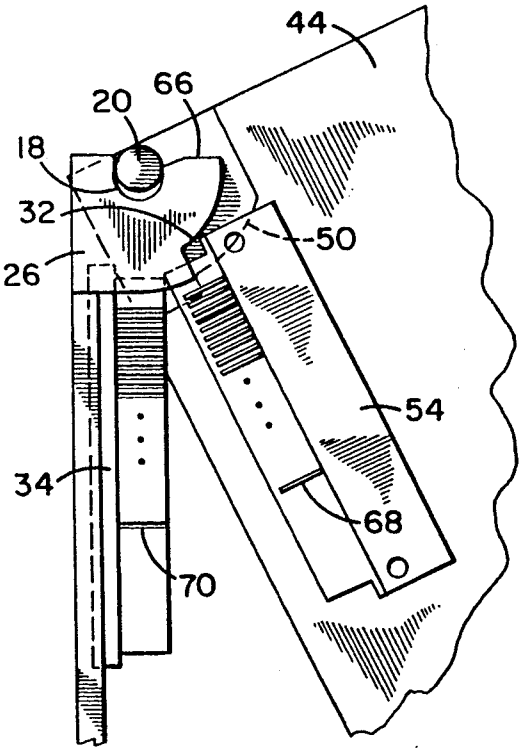
Figure 8G:
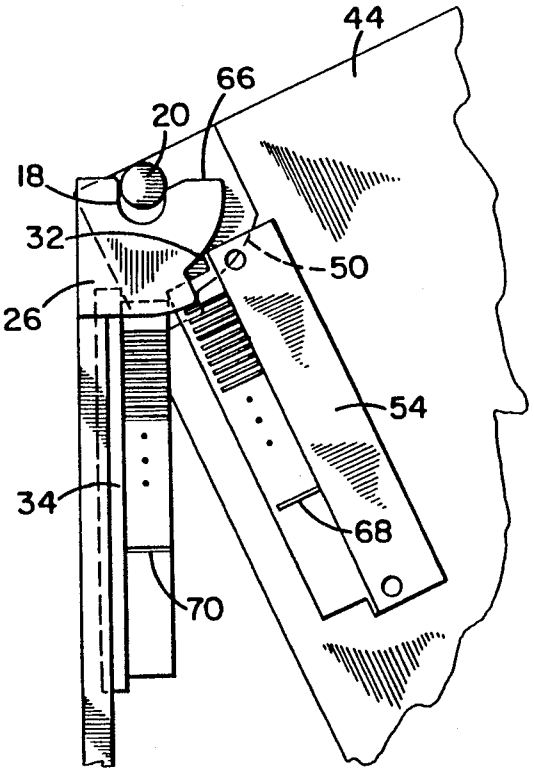

Following the succession of steps through from FIG. 8A until FIG. 8E, the pivot pin 20 proceeds horizontally along a lip 66 of the mounting rail 26 until the steps of each stepped guide surface 32, 50 are abutted against each other. At this point, the connector elements 34, 54 are prohibited from engaging since they are not properly aligned. Hence, they are positively prevented from engaging due to their misalignment.

Proper alignment and subsequent engagement can be obtained, however, by rocking the PLC module housing 44 radially outward along where the stepped guide surfaces 32, 50 are contacted until the pivot pin 20 is fully seated within the pivot slot 18. The sequence of steps detailing these radial seating adjustments are shown from FIG. 8E to FIG. 8I. Referring specifically to FIG. 8I, the pivot pin 20 is shown fully seated within the pivot slot 18 and the steps of each stepped guide surface 32, 50 are no longer abutted against each other so as to prohibit the engagement of the connector elements 34, 54. Thus, the connector elements 34, 54 are now free to be engaged by following an angular engagement approach that is dictated by the concentricity of the stepped guide surfaces 32, 50. This angular engagement approach is detailed in the succession of steps shown in FIGS. 8I through 8K, whereby FIG. 8K shows the connector elements 34, 54 to be fully engaged. FIG. 8L is provided to show another scenario wherein the present invention also acts to positively prevent the misengagement of the multipoint connector elements 34, 54 due to their misalignment.

Figure 8J:
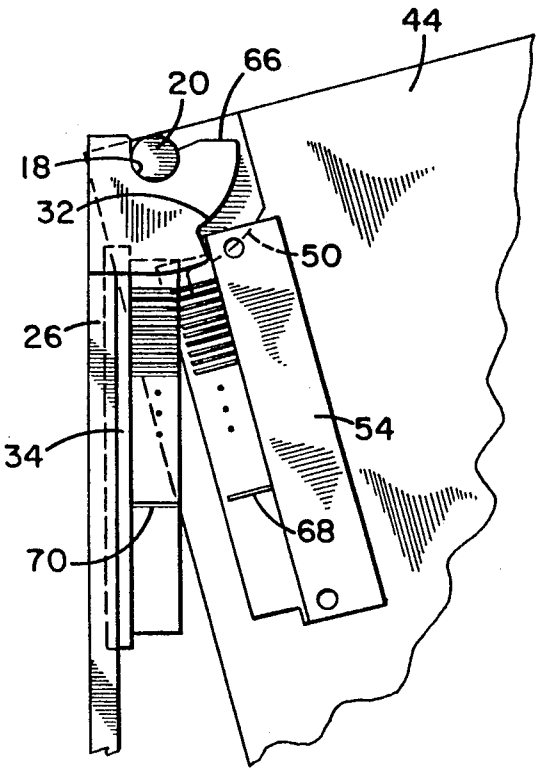
Figure 8I:
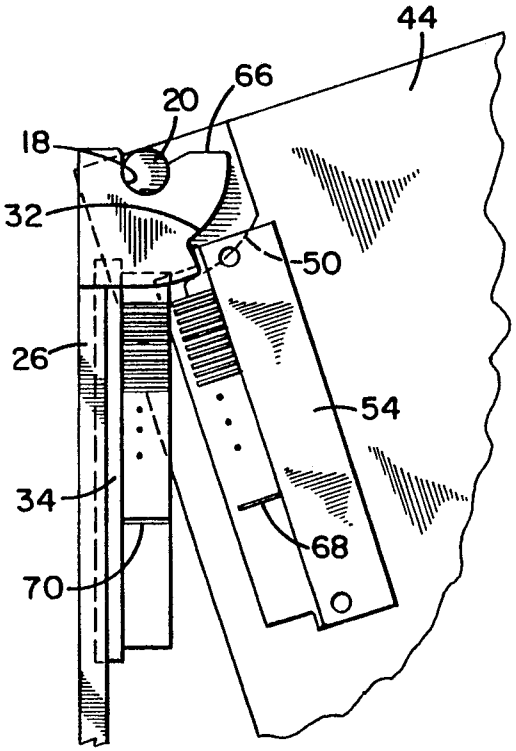
Figure 8L:
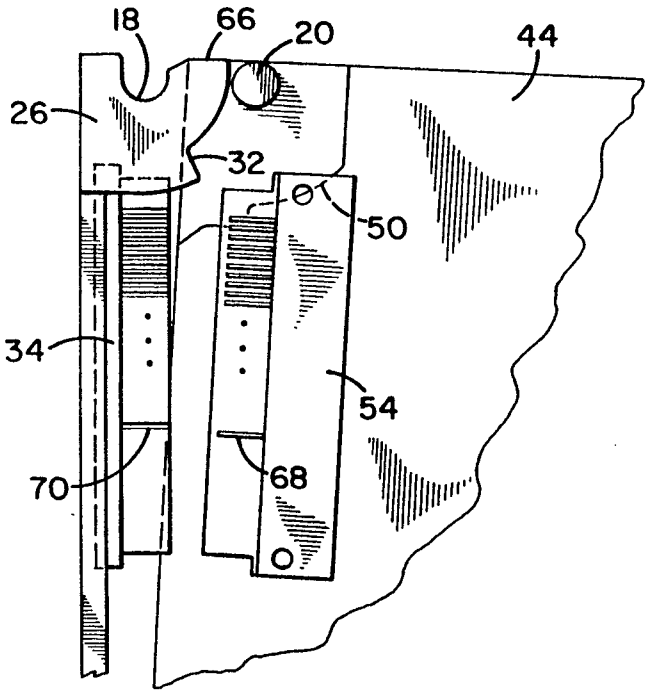
FIG. 8L shows one situation where misengagement of multipoint connector elements are positively prevented according to the present invention.
Figure 8K:
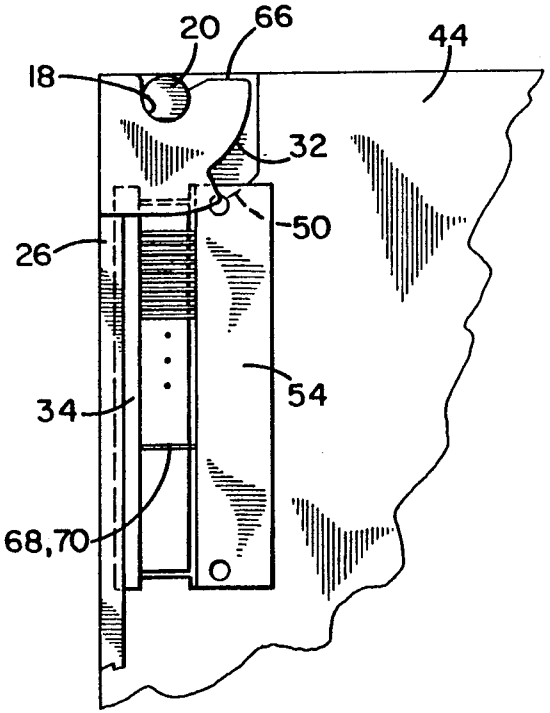

It should be noted that the angular engagement approach detailed in FIGS. 8I through 8K provides a supplemental benefit to the present invention method of positively preventing misengagement of multipoint connector elements. This supplemental benefit is that, due to the angular engagement approach between the plug multipoint connector element 54 and the receptacle multipoint connector element 34, electrical contact is made between the pins 68 of the plug element 54 and the sockets 70 of the receptacle element 34 in a sequential order, whereby the pins 68 and the sockets 70 closest to the pivot pin 20 and the pivot socket 18 arrangement are electrically contacted first. This electrical contact sequence is shown in FIGS. 8I, where electrical contact is made between a single pin and socket pair 72, through FIG. 8K, where electrical contact is made between all pin and socket pairs. Such an electrical contact sequence is a benefit since it is often desirable to transmit or receive certain electrical signals prior to others.

It should be further noted that the present invention also provides a similar supplemental benefit in that electrical contact is broken between the pins 68 of the plug element 54 and the sockets 70 of the receptacle element 34 in a sequential order when the multipoint connector elements 34, 54 are disengaged. Similarly, such a broken electrical contact sequence is a benefit since it is often desirable to transmit or receive certain electrical signals after electrical contact has been broken with others. The supplemental benefits of both the electrical contact sequence and the broken electrical contact sequence are affirmatively provided by the present invention.

It is thus seen that the objectives set forth above are efficiently obtained and, since certain changes may be made in the above described apparatus without departing from the scope of the invention, it is intended that all matter contained in the above description or shown in the accompanying drawings shall be interrupted as illustrative and not in a limiting sense.

What is claimed is:

1. An apparatus for positively preventing misengagement of multipoint connector elements, said apparatus comprising:

a plug element of a multipoint connector;

a receptacle element of a multipoint connector, wherein said plug element and said receptacle element may be engaged when properly aligned;

first alignment means associated with said multipoint connector elements for providing engagement alignment between said plug element and said receptacle element, wherein said first alignment means includes at least one pivot pin having an associated stepped guide surface with an associated step, the stepped guide surface disposed concentrically about said pivot pin; and second alignment means associated with said multipoint connector elements for providing engagement alignment between said plug element and said receptacle element, wherein said second alignment means includes at least one pivot slot having an associated stepped guide surface with an associated step, the stepped guide surface disposed concentrically about said pivot slot, such that each said pivot pin associated stepped guide surface is concentrically mated with a corresponding pivot slot associated stepped guide surface, wherein said pivot slot and said stepped guide surface of the second alignment means corresponding with said pivot pin and stepped guide surface of the first alignment means by having said steps abut against each other prior to engagement of said multipoint connector elements unless said pivot pin is fully seated in said pivot slot; thereby preventing misengagement of said multipoint connector elements unless said pivot pin is fully seated in said pivot slot, thus insuring that said multipoint connector elements are properly aligned.

2. The apparatus as defined in claim 1, wherein said concentrically mated stepped guide surfaces provide said multipoint connector elements with an angular engagement path when said pivot pin is fully seated in said pivot slot.

3. The apparatus as defined in claim 2, wherein said plug element has a plurality of pin contacts, wherein said receptacle element has a like plurality of socket contacts, and wherein said angular engagement path allows electrical contact between said pin contacts and said socket contacts in a sequential order.

4. The apparatus as defined in claim 1, wherein said concentrically mated stepped guide surfaces provide said multipoint connector elements with an angular disengagement path when said pivot pin is fully seated in said pivot slot.

5. The apparatus as defined in claim 4, wherein said plug element has a plurality of pin contacts, wherein said receptacle element has a like plurality of socket contacts, and wherein said angular disengagement path allows electrical contact to be broken between said pin contacts and said socket contacts in a sequential order.

6. The apparatus as defined in claim 1, wherein said first alignment means comprises a housing dimensioned for mounting one of said multipoint connector elements, wherein said housing provides two pivot pins and two associated stepped guide surfaces for said first alignment means which are seated in and are concentrically mated with two corresponding pivot slots and two corresponding associated stepped guide surfaces in said second alignment means, respectively.

7. The apparatus as defined in claim 6, wherein said housing is supported by said second alignment means.

8. The apparatus as defined in claim 7, wherein said housing is dimensioned for mounting said plug element.

9. The apparatus as defined in claim 7, wherein said housing is dimensioned for mounting said receptacle element.

10. The apparatus as defined in claim 1, wherein said second alignment means comprises a mounting assembly that maintains one of said multipoint connector elements, wherein said mounting assembly provides two pivot slots and two associated stepped guide surfaces for said second alignment means which provide seating for and are concentrically mated with two corresponding pivot slots and two corresponding associated stepped guide surfaces in said second alignment means, respectively.

11. The apparatus as defined in claim 10, wherein said mounting assembly supports said first alignment means.

12. The apparatus as defined in claim 11, wherein said mounting assembly maintains said receptacle element.

13. The apparatus as defined in claim 11, wherein said mounting assembly maintains said plug element.

14. A modular programmable logic controller (PLC) system having a mounting assembly and a PLC module, wherein said mounting assembly has an associated receptacle element of a multipoint connector and said PLC module has an associated plug element of a multipoint connector, and wherein said mounting assembly and said PLC module are formed to interact in a manner that positively prevents misengagement of said multipoint connector elements, said PLC system comprising:

a mounting assembly having a pivot slot with an associated stepped guide surface having an associated step, the stepped guide surface disposed concentrically about said pivot slot, said mounting assembly also having an associated receptacle element of a multipoint connector; and the PLC module having a pivot pin with an associated stepped guide surface having an associated step, the stepped guide surface disposed concentrically about said pivot pin, wherein said pivot pin and said stepped guide surface correspond with said pivot slot and said stepped guide surface of the mounting assembly so that said steps abut against each other prior to engagement of said multipoint connector elements unless said pivot pin is fully seated in said pivot slot, so that said pivot slot associated stepped guide surface is concentrically mated with said pivot pin associated stepped guide surface so as to positively prevent misengagement of said multipoint connector elements unless said pivot pin is fully seated in said pivot slot, thereby insuring that said multipoint connector elements are properly aligned.

15. The system as defined in claim 14, wherein said stepped guide surfaces are concentrically mated to provide said multipoint connector elements with an angular engagement path when said pivot pin is fully seated in said pivot slot.

16. The system as defined in claim 15, wherein said plug element has a plurality of pin contacts, wherein said receptacle element has a like plurality of socket contacts, and wherein said angular engagement path allows electrical contact between said pin contacts and said socket contacts in a sequential order.

17. The system as defined in claim 14, wherein said stepped guide surfaces are concentrically mated to provide said multipoint connector elements with an angular disengagement path when said pivot pin is fully seated in said pivot slot.

18. The system as defined in claim 17, wherein said plug element has a plurality of pin contacts, wherein said receptacle element has a like plurality of socket contacts, and wherein said angular disengagement path allows electrical contact to be broken between said pin contacts and said socket contacts in a sequential order.

* * * * *